United States Patent [19]

Savins

[11] Patent Number: 4,473,124

[45] Date of Patent: Sep. 25, 1984

[54] METHOD FOR OPERATING ROTARY DRILLING UNDER CONDITIONS OF HIGH CUTTINGS TRANSPORT EFFICIENCY

[75] Inventor: Joseph G. Savins, Dallas, Tex.

[73] Assignee: Mobil Oil Corporation, New York, N.Y.

[21] Appl. No.: 490,918

[22] Filed: May 2, 1983

[51] Int. Cl.[3] ..... E21B 43/00

[52] U.S. Cl. ..... 175/65; 252/8.5 C

[58] Field of Search ..... 175/65–70; 252/8.5 C, 8.5 P

[56] References Cited

U.S. PATENT DOCUMENTS

| | | | |
|---|---|---|---|
| 3,637,492 | 1/1972 | Kolaian | 252/8.5 C |
| 3,860,070 | 1/1975 | Herce et al. | 175/65 X |
| 3,878,110 | 4/1975 | Miller et al. | 175/65 X |
| 3,985,659 | 10/1976 | Felicetta et al. | 252/8.5 C |
| 4,322,301 | 3/1982 | Blackmore | 252/8.5 C X |
| 4,330,414 | 5/1982 | Hoover | 252/8.5 C X |

OTHER PUBLICATIONS

The Oil and Gas Journal, Jun. 26, 1967, vol. 65, No. 26, pp. 62–70, Deily et al.

*Primary Examiner*—Stephen J. Novosad
*Assistant Examiner*—Thuy M. Bui
*Attorney, Agent, or Firm*—A. J. McKillop; Michael G. Gilman; George W. Hager, Jr.

[57] ABSTRACT

In a rotary method of drilling a well into the earth employing a drilling mud system, the transport ratio (hole cleaning efficiency) is increased by increasing the yield point to plastic viscosity ratio of the drilling fluid while maintaining the plastic viscosity constant. In a preferred embodiment, the plastic viscosity is varied within the range of 7.5 to 30 centipoises and the yield point to plastic viscosity ratio is varied within the range of 0.20 to 1.5.

4 Claims, 3 Drawing Figures

METHOD FOR OPERATING ROTARY DRILLING UNDER CONDITIONS OF HIGH CUTTINGS TRANSPORT EFFICIENCY

FIELD OF THE INVENTION

The invention relates to the drilling of wells into the earth by rotary drilling techniques and more particularly to controlling the properties of the drilling fluid in the well to increase the cuttings transport efficiency.

BACKGROUND OF THE INVENTION

In the drilling of wells into the earth by rotary drilling techniques, a drill bit is attached to a drill string, lowered into a well, and rotated in contact with the earth; thereby breaking and fracturing the earth and forming a wellbore thereinto. A drilling fluid is circulated down the drill string and through ports provided in the drill bit to the bottom of the wellbore and thence upward through the annular space formed between the drill string and the wall of the wellbore. The drilling fluid serves many purposes including cooling the bit, supplying hydrostatic pressure upon the formations penetrated by the wellbore to prevent fluids existing under pressure therein from flowing into the wellbore, and hole cleaning (carrying capacity), i.e. the removal of drill solids (cuttings) beneath the bit, and the transport of this material to the surface through the wellbore annulus.

As summarized in COMPOSITION AND PROPERTIES OF OIL WELL DRILLING FLUIDS, 4th Edition, G. R. Gray, et al., Gulf Publishing Company, 1980, the term "drilling fluid" includes systems in which the principal constituent can be a gas, water, or oil, and the formulation injected through the drill bit may be as simple as a dry gas, "fresh water", lease crude, or as complex as a slurry, colloidal dispersion, emulsion, foam or mist containing oil and/or water, viscosifier, fluid loss additive, electrolytes, polymers, weighting material, surfactant, corrosion inhibitor, oxygen scavanger, defoamer, etc. Those drilling fluids generally inapplicable to this invention include the dry gas, mist, and "fresh water".

Factors directly and indirectly affecting the efficiency of removal of drill solids (cuttings) from the wellbore include (1) drilling fluid rheology, density, and chemical composition, (2) drilling conditions, e.g. drilling fluid circulation rate, bit rate of penetration, drill string rotational speed, available hydraulic horsepower, (3) drill solids characteristics, e.g. density, mineralogy, size, shape, strength, and (4) wellbore and drill string configuration and characteristics, e.g. inclination of the wellbore, dimensions of the annular channel and the drill string, eccentricity between the drill string and the wellbore and borehole stability.

A measure of the efficiency of the hole cleaning operation is the difference between the annular fluid velocity ($V_A$) and the terminal (slip) velocity ($V_S$) at which the largest cutting settles divided by the annular fluid velocity. The equation for determining transport ratio (TR) is $$TR = \left(\frac{V_A - V_S}{V_A}\right) \times 100$$

where $V_A$=annular fluid velocity $V_S$=terminal (slip) velocity.

Obviously total removal of drill solids would correspond to a transport ratio of 100 percent, however, this degree of efficiency can be difficult to achieve because of practical constraints on the factors enumerated above. Thus in practice it is customary to set some minimum value to this transport ratio based on experience in drilling operations in a certain area, or to relate the ratio to the maximum concentration of drill solids to be permitted in the annulus between the drill string and the wellbore wall.

The present invention provides a method for increasing the transport ratio, thereby improving the hole cleaning operation, by manipulating the rheological characteristics of the applicable drilling fluids described above. The particular rheological parameters manipulated are the plastic viscosity and yield point of liquid materials exhibiting plastic flow, parameters described by Savins in U.S. Pat. No. 2,703,006, the disclosure of which is hereby incorporated by reference, together with mathematical procedures for extracting same from viscometric data on said drilling fluid systems. More specifically, the present invention provides a method for hole cleaning while drilling a well wherein the transport ratio is increased by controlling the yield point and plastic viscosity of the drilling fluid in a prescribed manner.

SUMMARY OF THE INVENTION

In accordance with this invention there is provided a method of drilling a well into the earth under conditions of high cuttings transport efficiency wherein a drill string is located in said well and a drilling fluid is employed as the circulation medium between the surface of the earth and the bottom of the well, the improvement comprising employing a drilling fluid having a constant plastic viscosity and increasing the ratio of yield point to plastic viscosity within a predetermined range with consequent increase in transport ratio. Preferably, the plastic viscosity is varied within the range of 7.5 to 30 centipoises and the yield point to plastic viscosity ratio is varied within the range of 0.20 to 1.5.

DESCRIPTION OF THE PREFERRED EMBODIMENTS

This invention relates to a rotary method of drilling a wellbore into the earth wherein transport ratio is improved by maintaining the plastic viscosity of the drilling fluid constant and increasing the ratio of yield point to plastic viscosity within a prescribed range.

Utilizing a model of cuttings transport I can demonstrate my method for attaining high cuttings transport efficiency in a rotary drilling operation employing a drilling fluid having prescribed physical properties. Table 1 below lists the drilling operation data that were used in the simulation model for a narrow annulus (Case A) and a wide annulus (Case B).

TABLE 1

| | CASE A | CASE B |
|---|---|---|
| Annulus effective diameter (inches) | 4.25 | 7.25 |
| Hole Inclination (degrees) | 60 | 60 |
| Annulus diameter ratio | 0.653 | 0.408 |
| Annulus fluid velocity (ft/min) | 133.0 | 91.5 |
| Rate of Penetration (ft/hr) | 17 | 17 |
| Mud weight (lb/gal) | 9.5 | 9.5 |

Figure 1:
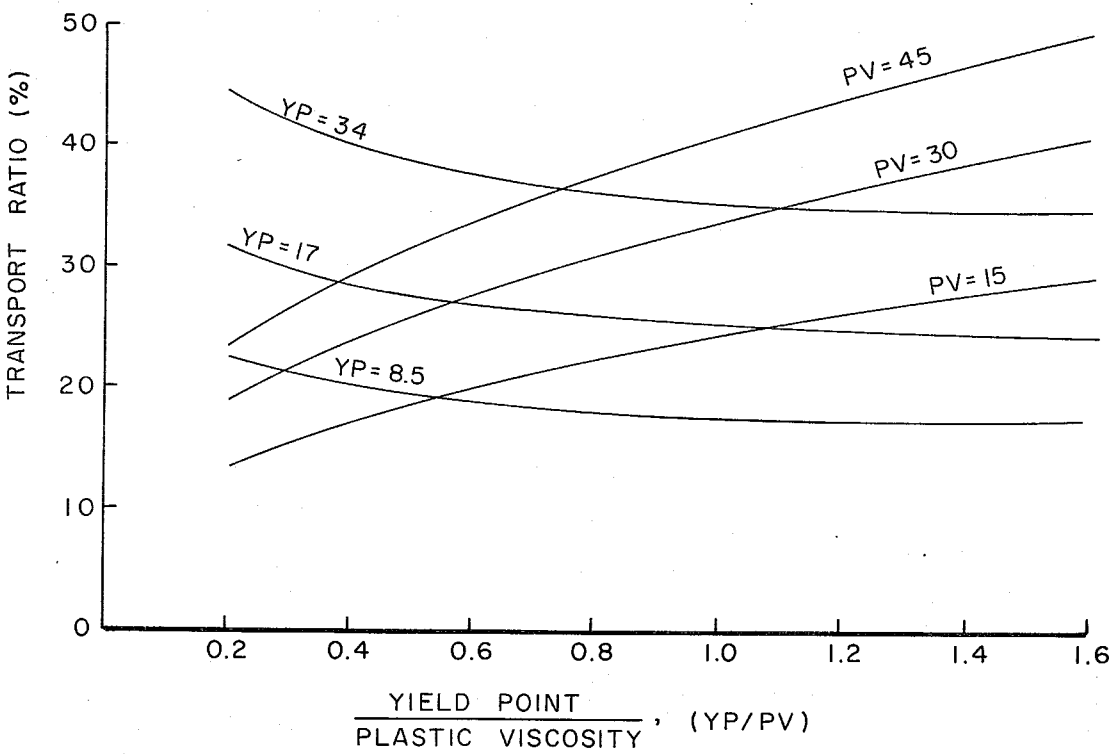
FIGS. 1 and 2 show the effect on transport ratio in a drilling operation by varying the yield point and plastic viscosity of the drilling fluid in accordance with the present invention using a narrow annulus and a wide annulus between the drill string and the wellbore wall.
Figure 2:
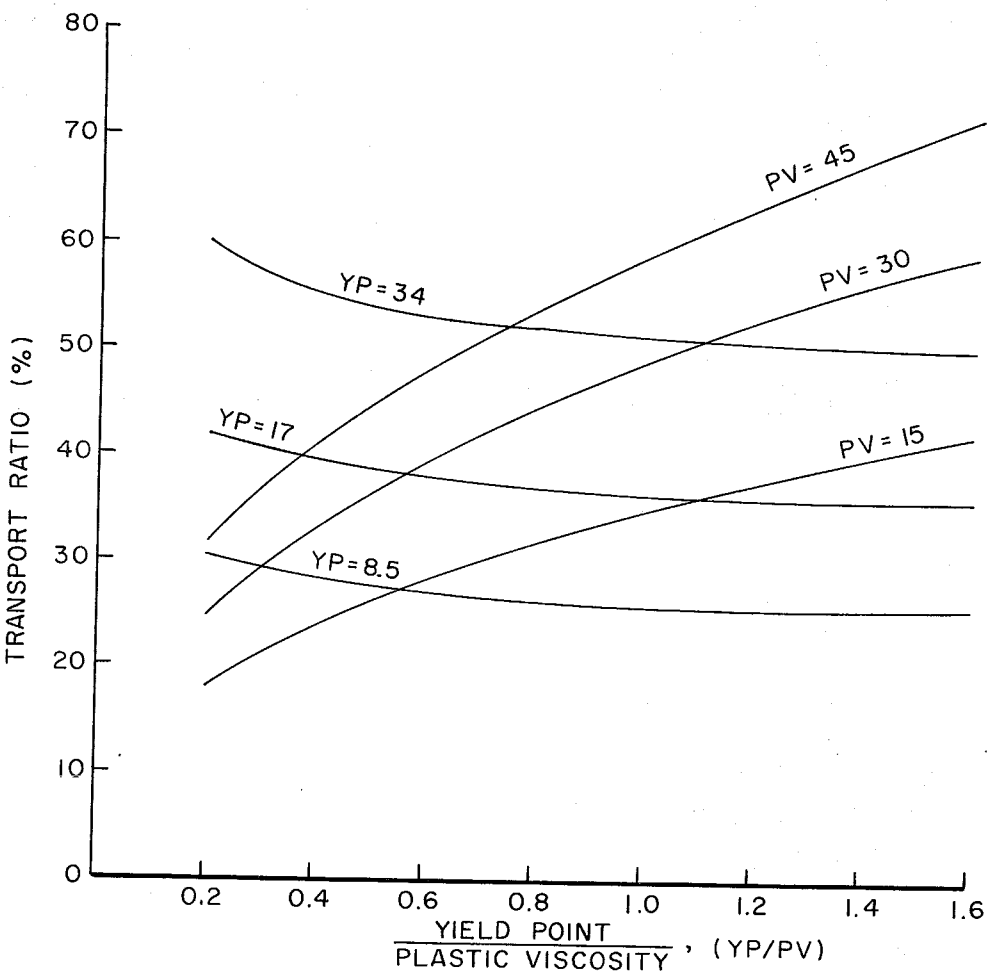

Results of these simulations are summarized in FIGS. 1 and 2 that show that transport ratio is sensitive to the manner in which the yield point (YP) to plastic viscosity (PV) ratio is manipulated. FIG. 1 illustrates the relationship between the transport ratio and rheology for Case A, corresponding to a narrow annulus between the drill string and the wellbore wall, while FIG. 2 illustrates the relationships for Case B, corresponding to a wide annulus. Focusing attention on the curves showing a parametric dependence on the yield point, it is seen that increasing the YP/PV ratio while maintaining YP constant results in a monotonic decrease in transport ratio over the full range of YP/PV scanned. By contrast, the curves showing a parametric dependence on plastic viscosity illustrate a dramatic increase in transport ratio while increasing the YP/PV ratio at a constant plastic viscosity. These simulations also demonstrate that maintaining a particular YP/PV ratio within some preferred range can actually require sustantially larger plastic viscosities to maintain adequate transport ratios in drilling fluids characterized by small true yield points. Thus low solids-polymers-and inverted emulsions-type drilling fluids with true yield points less than about 10 lb/100 ft$^2$ can require plastic viscosities of the order of 30 cp to obtain transport ratios above 25 percent in wide annular channels of highly deviated wellbores.

The results in FIG. 1 for a narrow annulus show that the transport ratio is increased from about 25% to about 40% if the plastic viscosity is maintained at 30 cp and the yield point to plastic viscosity ratio is increased from about 0.5 to about 1.5. The results in FIG. 2 for a wide annulus show that the transport ratio is increased from about 25% to about 40% if the plastic viscosity is maintained at 15 cp and the yield point to plastic viscosity ratio is increased from about 0.5 to about 1.5.

This invention can be illustrated by the following example in which while drilling upper, intermediate, and production intervals, the target transport ratios in the annular channel between the open hole and drill collar are to be 26.5 percent, 34.0 percent, and 59.5 percent, respectively. The drilling conditions corresponding to these phases are summarized below.

TABLE 2

| | INTERVAL | | |
|---|---|---|---|
| | Upper | Intermediate | Production |
| Hole Inclination (degrees) | 0 | 15 | 60 |
| Annulus effective diameter (inches) | 9 | 4.25 | 3.7 |
| Annulus diameter ratio | 0.470 | 0.653 | 0.574 |
| Annulus fluid velocity (ft/min) | 88 | 150 | 185 |
| Rate of Penetration (ft/hr) | 75 | 50 | 15 |
| Plastic Viscosity (cp) | 5 | 15 | 35 |
| Yield Point (initial) | 1.25 | 3.75 | 8.75 |
| Mud Weight (lb/gal) | 9.5 | 10.5 | 11.0 |

Figure 3:
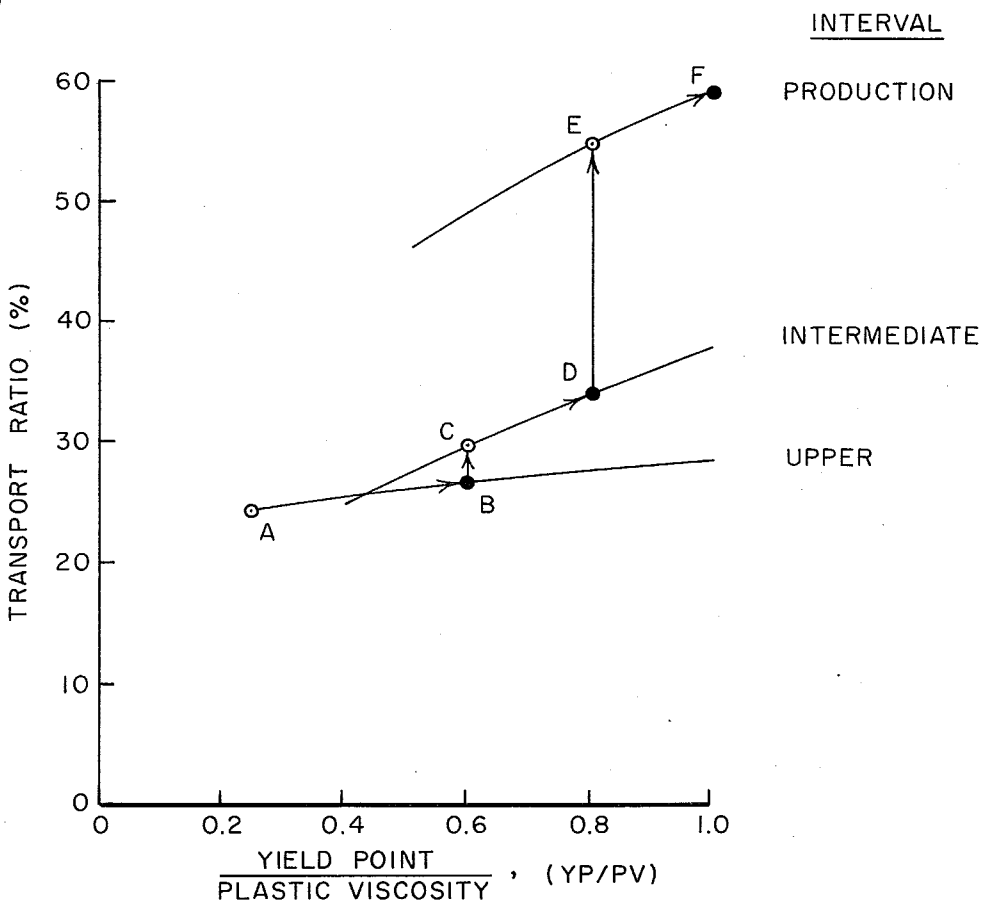
FIG. 3 shows the relationship between transport ratio and the ratio of yield point to plastic viscosity while drilling upper, intermediate, and production intervals.

The relationships between rheology and transport ratio for these intervals are illustrated in FIG. 3, wherein the open circles denoted by points A, C, and E represent initial conditions (before the YP/PV ratio is manipulated), and the shaded circles denoted by points B, D, and F represent the target values of the transport ratio. The sequence of manipulation of the plastic viscosity and the ratio of yield point to plastic viscosity can be understood by tracing the steps outlined. Thus, in drilling the upper interval, the target value of 26.5 percent is obtained by maintaining the plastic viscosity constant at 5 cp and raising the YP/PV ratio from 0.25 to 0.60. Similarly in drilling the intermediate interval, the target value of 34 percent is obtained by first raising the plastic viscosity to 15 cp and the yield point to 3.75 lb/100 ft$^2$, and then raising the YP/PV ratio from 0.6 to 0.8 while maintaining the plastic viscosity constant. Finally, in drilling the production interval, the target value of 59.5 percent is obtained by first raising the plastic viscosity and yield point to 35 cp and 8.75 lb/100 ft$^2$, respectively, and then raising the YP/PV ratio from 0.8 to 1.0 while maintaining a constant plastic viscosity. The sequences of steps outlined and the manner of manipulation of rheology serve simply to illustrate one way of operating rotary drilling under conditions of high cuttings transport efficiency.

In order to properly exploit the benefits of this invention, some adjustments in rheology may be required, depending on the type drilling fluid used, drilling conditions, drill solids characteristics, and wellbore drill string configuration. Thus under laminer flow conditions with a wide annulus in a highly deviated wellbore, with a plastic viscosity of about 7.5 cp, a preferred embodiment is a yield point to plastic viscosity ratio of about 0.75, while with a plastic viscosity of about 30 cp, a preferred embodiment is a yield point to plastic viscosity ratio of about 0.20. Similarly, under laminer flow conditions with a narrow annulus in a highly deviated wellbore, with a plastic viscosity of about 15 cp, a preferred embodiment is a yield point to plastic viscosity ratio of about 1.0.

Having thus described my invention, it will be understood that such description has been given by way of illustration and not by way of limitation, reference for the latter purpose being had to the appended claims.

What is claimed is:

1. A method of drilling a well into the earth wherein a drill string is located in said well and an active drilling fluid system is employed in the circulation of drilling fluid between the surface of the earth and the bottom of the well, the improvement comprising employing a drilling fluid exhibiting plastic flow maintained at a constant plastic viscosity and increasing the ratio of yield point to plastic viscosity within a predetermined range thereby increasing transport ratio.

2. The method of claim 1 wherein the plastic viscosity is maintained within the range of 15 to 30 centipoises and the yield point to plastic viscosity ratio is increased from 0.20 to 1.5.

3. A method of drilling a well into the earth wherein a drill string is located in said well and an active drilling fluid system is employed in the circulation of drilling fluid into said drill string and upwardly through the annular space between the drill string and the wall of the well, said well being drilled under laminar flow conditions with a wide annulus in a highly deviated wellbore, the improvement comprising employing a drilling fluid exhibiting plastic flow maintained at a plastic viscosity of about 15 centipoises and increasing the yield point to plastic viscosity ratio from about 0.4 to about 1.5 thereby increasing the transport ratio from about 25% to about 40%.

4. A method of drilling a well into the earth wherein a drill string is located in said well and an active drilling fluid system is employed in the circulation of drilling fluid into said drill string and upwardly through the annular space between the drill string and the wall of the well, said well being drilled under laminar flow conditions with a narrow annulus in a highly deviated wellbore, the improvement comprising employing a drilling fluid exhibiting plastic flow maintained at a plastic viscosity of about 30 centipoises and increasing the yield point to plastic viscosity ratio from about 0.5 to about 1.5 thereby increasing the transport ratio from about 25% to about 40%.

* * * * *